US012246245B1

(12) United States Patent
Silva et al.

(10) Patent No.: US 12,246,245 B1
(45) Date of Patent: Mar. 11, 2025

(54) SEGMENTED SIDERAILS FOR ONE-WHEELED VEHICLES

(71) Applicant: Future Motion, Inc., Santa Cruz, CA (US)

(72) Inventors: Austen Silva, Santa Cruz, CA (US); Julian De La Rua, Santa Cruz, CA (US)

(73) Assignee: FUTURE MOTION, INC., Santa Cruz, CA (US)

( * ) Notice: Subject to any disclaimer, the term of this patent is extended or adjusted under 35 U.S.C. 154(b) by 0 days.

(21) Appl. No.: 18/736,091

(22) Filed: Jun. 6, 2024

(51) Int. Cl.
*A63C 17/12* (2006.01)
*A63C 17/08* (2006.01)

(52) U.S. Cl.
CPC ..... *A63C 17/12* (2013.01); *A63C 17/08* (2013.01); *A63C 2203/24* (2013.01); *A63C 2203/42* (2013.01)

(58) Field of Classification Search
CPC ..... A63C 17/12; A63C 17/08; A63C 17/014; A63C 17/016; A63C 2203/24; A63C 2203/42
See application file for complete search history.

(56) References Cited

U.S. PATENT DOCUMENTS 4,795,181 A * 1/1989 Armstrong ..... A63C 17/012 D21/765
5,119,277 A * 6/1992 Copley ..... A63C 17/26 362/543
9,643,077 B2 * 5/2017 Bigler ..... A63C 17/014
D850,552 S 6/2019 Doerksen
10,456,658 B1 * 10/2019 Doerksen ..... B60L 3/0007
11,273,364 B1 3/2022 Doerksen et al.
11,325,021 B1 5/2022 McCosker
D999,861 S 9/2023 Doerksen et al.
11,890,528 B1 2/2024 Doerksen et al.
2006/0012141 A1 * 1/2006 Bouvet ..... A63C 17/12 280/87.042
2007/0035101 A1 * 2/2007 Gregory ..... A63C 17/0086 280/87.042
2008/0242515 A1 * 10/2008 Odien ..... A63B 26/003 482/146
2012/0139203 A1 * 6/2012 Tedla ..... A63C 17/004 29/428
2014/0326525 A1 11/2014 Doerksen
2017/0361205 A1 12/2017 Bigler
2018/0015354 A1 * 1/2018 Huang ..... A63C 17/0033
2018/0161661 A1 * 6/2018 Ma ..... A63C 17/1418
2019/0299082 A1 * 10/2019 Hoover ..... A63C 17/08

FOREIGN PATENT DOCUMENTS

KR 1020190089558 A 7/2019
WO WO2017077362 A1 5/2017

* cited by examiner

*Primary Examiner* — Frank B Vanaman
(74) *Attorney, Agent, or Firm* — Kolitch Romano Dascenzo Gates LLC

(57) ABSTRACT

A siderail for a one-wheeled vehicle may include an elongate structural rail having a web extending from a first longitudinal end to a second longitudinal end. The rail is defined by four segments: a central segment defining a horizontal reference, a rear segment extending directly away from the central segment at an upward angle, a first forward segment extending directly away from the central segment at a downward angle, and a second forward segment extending directly away from the first forward segment at an upward angle.

20 Claims, 7 Drawing Sheets

SEGMENTED SIDERAILS FOR ONE-WHEELED VEHICLES

CROSS-REFERENCES

The following applications and materials are incorporated herein, in their entireties, for all purposes: U.S. Pat. Nos. 9,101,817; 9,452,345.

FIELD

This disclosure relates to systems and methods for self-stabilizing one-wheeled electric vehicles. More specifically, the disclosed embodiments relate to siderails suitable for use with such vehicles.

SUMMARY

The present disclosure provides systems, apparatuses, and methods relating to improved siderails for one-wheeled vehicles.

In some examples, a siderail for a one-wheeled vehicle may include: a structural rail extending from a front longitudinal end to a rear longitudinal end, two side-by-side apertures passing through a web of the rail and configured to receive corresponding fasteners to couple the rail (directly or indirectly) to an axle of the one-wheeled vehicle; wherein an imaginary line through centers of the two apertures defines a horizontal reference; wherein the rail comprises a rearmost section extending rearward at an upward angle relative to the horizontal and a frontmost section extending forward at an upward angle relative to the horizontal; and wherein the rear longitudinal end of the rail is higher than the front longitudinal end of the rail.

In some examples, a one-wheeled vehicle may include: a board including first and second deck portions coupled to a frame, each deck portion configured to receive a left or right foot of a rider oriented generally perpendicular to a direction of travel of the board; a wheel disposed between and extending above the first and second deck portions; a hub motor configured to rotate the wheel around an axle to propel the vehicle; and a motor controller configured to cause the hub motor to propel the vehicle based on an orientation of the board; wherein the frame comprises a siderail having a web extending from a first longitudinal end to a second longitudinal end; wherein the siderail includes: a rear segment extending rearward at an upward angle, a first forward segment extending forward at a downward angle, and a second forward segment extending from the first forward segment at an upward angle.

Features, functions, and advantages may be achieved independently in various embodiments of the present disclosure, or may be combined in yet other embodiments, further details of which can be seen with reference to the following description and drawings.

DETAILED DESCRIPTION

Figure 1:
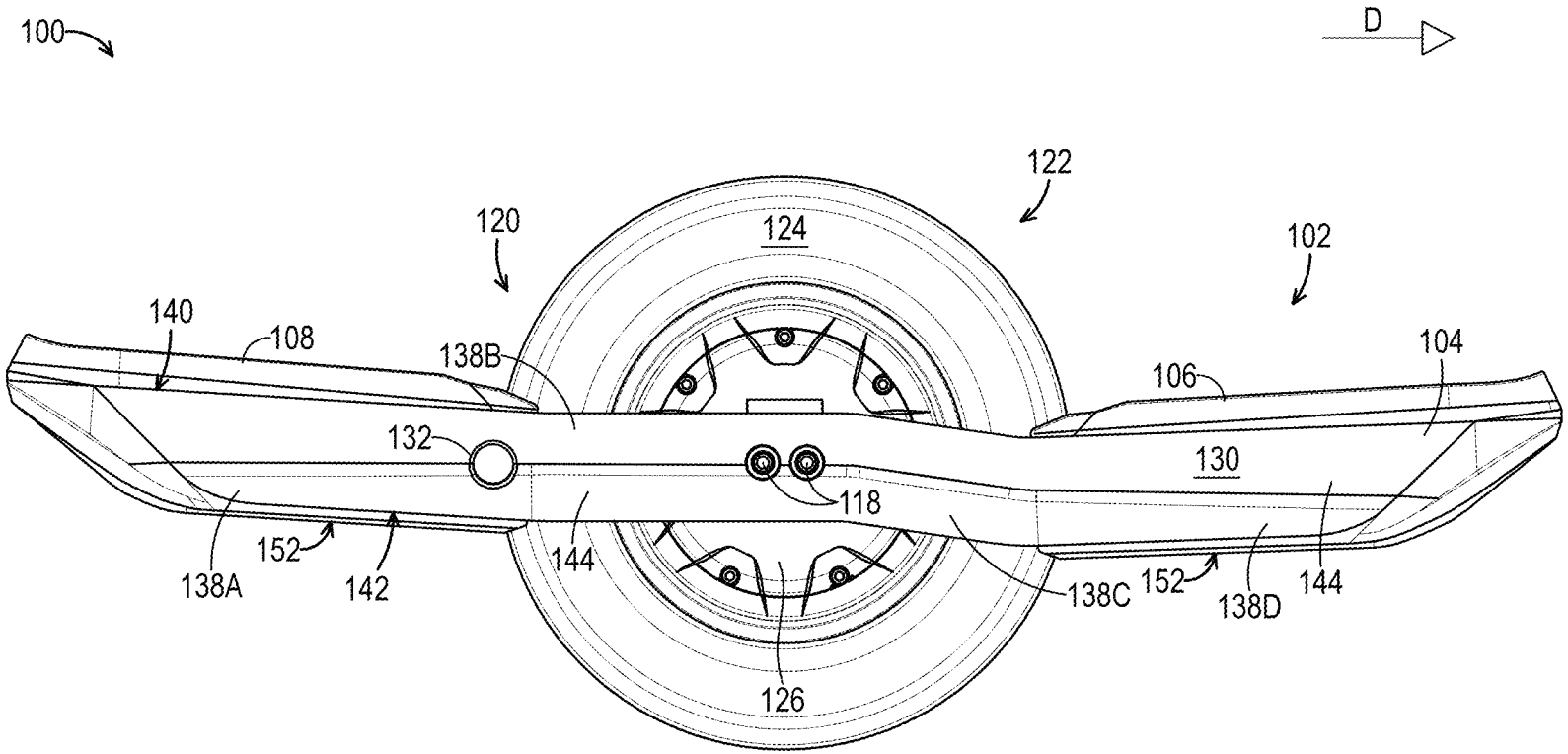
FIG. 1 is a side elevation view of an illustrative one-wheeled electric vehicle, in accordance with aspects of the present disclosure.

Various aspects and examples of siderails for one-wheeled vehicles, as well as related methods, are described below and illustrated in the associated drawings. Unless otherwise specified, a siderail in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

The terms "inboard," "outboard," "forward," "rearward," and the like are intended to be understood in the context of a host vehicle on which systems described herein may be mounted or otherwise attached. For example, "outboard" may indicate a relative position that is laterally farther from the centerline of the vehicle, or a direction that is away from the vehicle centerline. Conversely, "inboard" may indicate a direction toward the centerline, or a relative position that is closer to the centerline. Similarly, "forward" means toward the front portion of the vehicle, and "rearward" means toward the rear of the vehicle. In the absence of a host vehicle, the same directional terms may be used as if the vehicle were present. For example, even when viewed in isolation, a device may have a "forward" edge, based on the fact that the device would be installed with the edge in question facing in the direction of the front portion of the host vehicle.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

"Processing logic" describes any suitable device(s) or hardware configured to process data by performing one or more logical and/or arithmetic operations (e.g., executing coded instructions). For example, processing logic may include one or more processors (e.g., central processing units (CPUs) and/or graphics processing units (GPUs)), microprocessors, clusters of processing cores, FPGAs (field-programmable gate arrays), artificial intelligence (AI) accelerators, digital signal processors (DSPs), and/or any other suitable combination of logic hardware.

A "controller" or "electronic controller" includes processing logic programmed with instructions to carry out a controlling function with respect to a control element. For example, an electronic controller may be configured to receive an input signal, compare the input signal to a selected control value or setpoint value, and determine an output signal to a control element (e.g., a motor or actuator) to provide corrective action based on the comparison. In another example, an electronic controller may be configured to interface between a host device (e.g., a desktop computer, a mainframe, etc.) and a peripheral device (e.g., a memory device, an input/output device, etc.) to control and/or monitor input and output signals to and from the peripheral device.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, siderails (also referred to as stabilizing siderails or rails) in accordance with the present teachings are configured to be utilized as structural components (e.g., replaceable or interchangeable components) of the frame of a one-wheeled electric vehicle. One-wheeled electric vehicles of the present disclosure include self-stabilizing skateboards, such as those described in U.S. Pat. No. 9,101,817 (the '817 patent). Accordingly, one-wheeled vehicles of the present disclosure include a board defining a riding plane and a frame supporting a first deck portion and a second deck portion (collectively referred to as the foot deck). Each deck portion is configured to receive a left or right foot of a rider oriented generally perpendicular to a direction of travel of the board.

One-wheeled vehicles of the present disclosure include a wheel assembly having a rotatable, ground-contacting element (e.g., a tire, wheel, or continuous track) disposed between and extending above the first and second deck portions. The wheel assembly further includes a hub motor configured to rotate the ground-contacting element to propel the vehicle.

As described in the '817 patent, the one-wheeled vehicle includes at least one sensor configured to measure orientation information of the board, and a motor controller configured to receive orientation information measured by the sensor and to cause the hub motor to propel the vehicle based on the orientation information.

The deck portions may include any suitable structures configured to support the feet of a rider, such as non-skid surfaces, as well as vehicle-control features, such as a rider detection system. Illustrative deck portions, including suitable rider detection systems, are described in the '817 patent, as well as in U.S. Pat. No. 9,452,345.

The frame may include any suitable structure (including, e.g., siderails of the present disclosure) configured to rigidly support the deck portions and to be coupled to an axle of the wheel assembly. Coupling to the wheel assembly may be direct, e.g., by bolting to a central axle, or may be done via a suspension system. Accordingly, the weight of a rider may be supported on the tiltable board, having a fulcrum at the wheel assembly axle.

Specifically, in a one-wheeled electric vehicle according to the present teachings, the frame includes one or more siderails (AKA frame portions, stabilizing siderails) on which the deck portions are mounted. In some examples, the frame includes a pair of siderails, the first deck being coupled to both siderails at a first end and the second deck coupled to the siderails at a second end. The siderails are disposed on opposing lateral sides of the board, such that the wheel assembly is disposed between the siderails. In some examples, the siderails are fastened to opposing ends of the wheel axle, e.g., by a pair of bolts on each side. Each siderail may comprise a structural beam, strip, or frame member. In some examples, each siderail is monolithic, continuous, and/or formed as a single piece, e.g., via an extrusion process.

To provide various advantages, such as a lower center of gravity, front end ground clearance, foot angle comfort, and enhanced rear-end ground clearance for better range of motion, e.g., during downhill operation, siderails of the present disclosure each define a plurality of segments arranged at angles to each other. When discussing the segments, reference to various angles, orientations, and relative dispositions is understood to be with respect to a longitudinal centerline of the segment in question, and the siderail is understood to be in its normal operating disposition, with a top edge of the siderail further from the ground than a bottom edge of the siderail. However, in examples where the top and/or bottom edges are generally linear and parallel to the longitudinal centerline, then reference to the angles and orientations may be understood with respect to the top (or bottom) edge of each segment or section as the case may be. For clarity, a horizontal or reference orientation may be defined.

Based on a reference orientation (e.g., a zero-degree angle, horizontal, or an x-axis), a rearmost segment extends at a shallow angle upward (e.g., +3 to +4 degrees above the reference), such that a distal end of the rearmost segment is higher than the a proximal end of that segment. The horizontal reference may be defined by an imaginary line passing through the centers of two side-by-side mounting apertures through a web of the siderail.

At the other end of the siderail, a frontmost segment extends at an angle upward (e.g., +2 to +3 degrees above the reference), such that a distal end of the frontmost segment is higher than a proximal end. In general, the distal ends of the rearmost and frontmost segments define the ends of the siderail. In some examples, the rear end of the siderail is higher than the front end, relative to the horizontal reference. An entirety of a top edge of the rearmost section may be disposed above or higher than the frontmost section.

In some examples, further sections or segments may be defined. In the forward direction, a forward section may extend forward at a downward angle relative to the horizontal, and the frontmost section extends forward from the forward section at an upward angle relative to the horizontal. The forward segment (AKA a first forward segment) extends at an angle downward (e.g., −9 to −10 degrees, or 9-10 degrees below the reference). A central segment may be defined, and the two side-by-side apertures may be formed in the central segment. When present, the rearmost section and the (first) forward section extend directly from opposite ends of the central section. In summary, if the central segment is held in the horizontal position, then going rearward the siderail angles up, and going forward the siderail angles down and then back up. A reference height may be defined by the central segment when in a horizontal orientation. In some examples the front end of the siderail ends at a point below or lower than the height of the central segment. In some examples, the rear end of the siderail ends at a point above or higher than the front distal end.

In some examples, a rear end of the central section is level with or higher than a front end of the central section. In some examples, a top edge of the central section is linear and horizontal. In some examples, a top and/or bottom edge of the central section has a curvilinear profile. In some examples, the centers of the side-by-side apertures lie on a longitudinal centerline of the central section.

In some examples, the first forward segment is shorter than the frontmost (AKA second forward) segment. In some examples, a front-to-rear midpoint of the siderail lies on the central segment. In some examples, the central segment is configured to be fastened to the axle of the vehicle (e.g., having two bolt holes). In some examples, the siderail has a width (top to bottom) and a length (end to end), such that an imaginary line connecting the front top corner of the siderail to the rear top corner of the siderail does not intersect any other portion of the siderail. In other words, the tip-to-tip imaginary line is spaced apart from the other segments.

The top and bottom edges of the siderail may generally follow each other, e.g., in a parallel fashion, with distal ends being tapered, blunt, squared off, or any other suitable termination topology. For example, a siderail may have a same width (top to bottom, e.g., measured perpendicular to the top edge) throughout a majority of its length. In some examples, the bottom edge of a siderail has a profile which essentially replicates the profile of the top edge. Some or all of the segments may include linear strips, and transitions between segments may be sharp-cornered, serpentine, or a combination thereof (e.g., having radiused corners). In some examples, a plurality of the sections of the rail are generally rectilinear. At least one of the sections may have a curvilinear profile, and at least one transition between adjacent sections may be radiused.

The frame may support one or more additional elements and features of the vehicle, e.g., a charging port, end bumpers, lighting assemblies, battery and electrical systems, electronics, controllers, etc.

As mentioned above, the hub motor is controlled by a motor controller configured to receive orientation information regarding the board. Aspects of the electrical control systems described herein (e.g., the motor controller) may be embodied as a computer method, computer system, or computer program product. Accordingly, aspects of the present control systems may include processing logic and may take the form of an entirely hardware embodiment, an entirely software embodiment (including firmware, resident software, micro-code, and the like), or an embodiment combining software and hardware aspects, all of which may generally be referred to herein as a "circuit," "module," or "system." Furthermore, aspects of the present control systems may take the form of a computer program product embodied in a computer-readable medium (or media) having computer-readable program code/instructions embodied thereon.

Examples, Components, and Alternatives

The following sections describe selected aspects of illustrative siderails, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative One-Wheeled Vehicle

Figure 2:
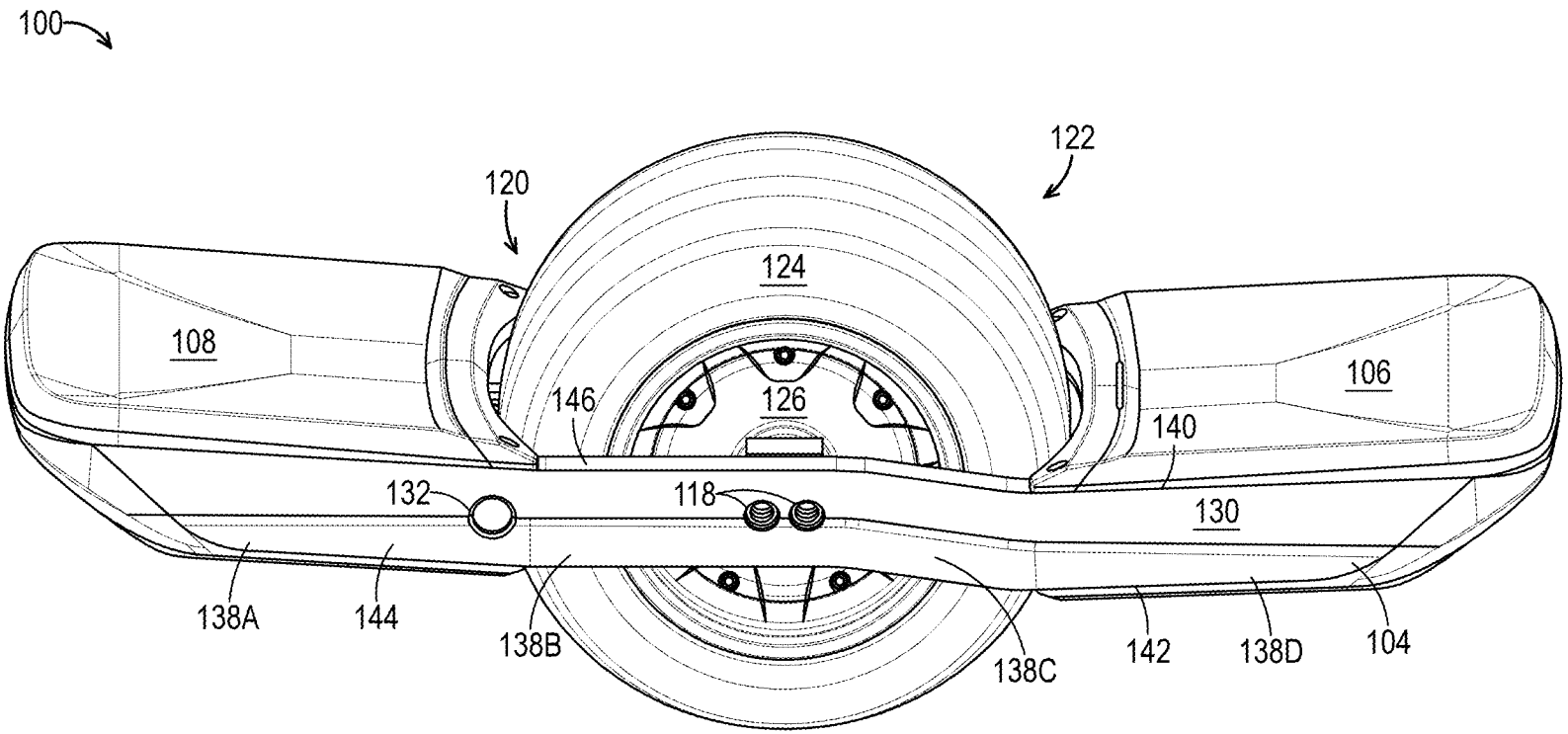
FIG. 2 is a side view of the vehicle of FIG. 1 taken from a higher angle.
Figure 3:
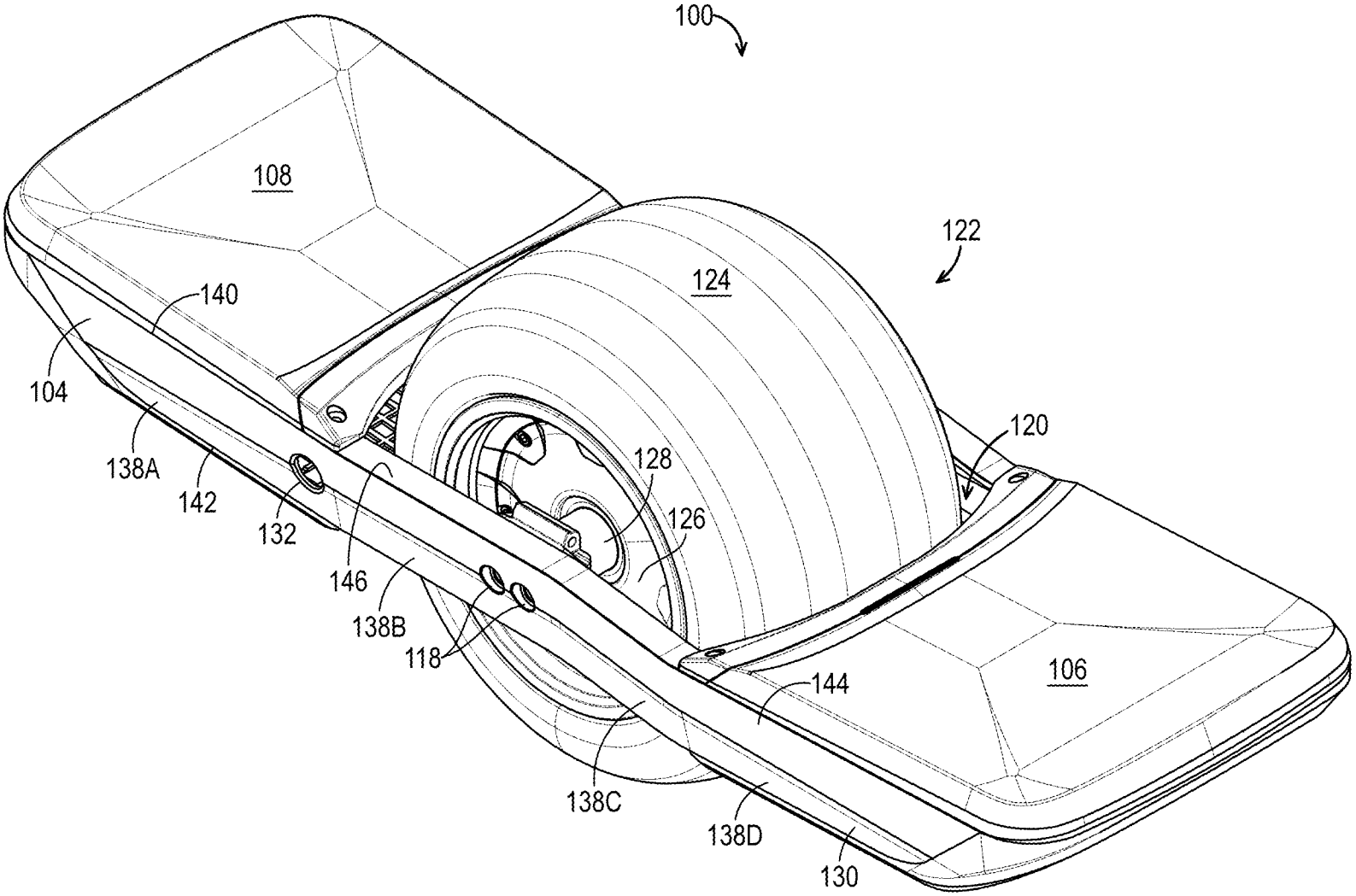
FIG. 3 is an isometric oblique view of the vehicle of FIG. 1.

As shown in FIGS. 1-3, this section describes an illustrative vehicle 100 suitable for use with the siderails described above.

Vehicle 100 is a one-wheeled, self-stabilizing skateboard including a board 102 (AKA a tiltable portion of the vehicle, a platform, a foot deck) having a frame 104 supporting a first deck portion 106 and a second deck portion 108 defining an opening 120 therebetween. Frame 104 comprises two siderails 130, each of which couples to first deck portion 106 and second deck portion 108 at distal ends. Board 102 may generally define a plane, although each foot deck is slightly angled and at a different overall height. Each deck portion 106, 108 (e.g., including a foot pad) is configured to receive and support a left or right foot of a rider oriented generally perpendicular to a direction of travel D of the board.

Vehicle 100 also includes a wheel assembly 122. Wheel assembly 122 includes a rotatable ground-contacting element 124 (e.g., a tire, wheel, or continuous track) disposed between and extending above first and second deck portions 106, 108, and a motor assembly 126 configured to rotate ground-contacting element 124 to propel the vehicle. As shown in FIG. 1 and elsewhere, vehicle 100 may include exactly one ground-contacting element, disposed between the first and second deck portions. In some examples, vehicle 100 may include a plurality of (e.g., coaxial) ground-contacting elements.

Wheel assembly 122 is disposed between first and second deck portions 106, 108. Ground-contacting element 124 is coupled to motor assembly 126. An axle 128 (AKA a shaft) of motor assembly 126 is coupled to board 102 at each siderail 130, in this example by a pair of spaced-apart bolts on each end of the axle, received through corresponding bolt holes 118 in the siderail. Accordingly, the spaced apart bolts through the siderails prevent the axle and siderails from rotating relative to each other, because motor assembly 126 is configured to rotate ground-contacting element 124 around (or about) axle 128 to propel vehicle 100. For example, motor assembly 126 may include an electric motor, such as a hub motor, configured to rotate ground-contacting element 124 about axle 128 to propel vehicle 100 along the ground. For convenience, ground-contacting element 124 is hereinafter referred to as a tire or wheel, although other suitable embodiments may be provided. In some examples, an imaginary line H through the centers of spaced-apart bolt holes 118 in each respective siderail 130 defines a level or horizontal or "rest" position for the board.

First and second deck portions 106, 108 are located on opposite sides of wheel assembly 122, with board 102 being dimensioned to approximate a skateboard. In some examples, the board may approximate a longboard skateboard, snowboard, surfboard, or may be otherwise desirably dimensioned. In some examples, deck portions 106, 108 of board 102 are at least partially covered with a non-slip or nonskid material (e.g., grip tape or other textured material) to aid in rider control.

Frame 104 may include any suitable structure configured to rigidly support the deck portions and to be coupled to the axle of the wheel assembly, such that the weight of a rider is supportable on tiltable board 102. Frame 104 generally has a fulcrum at the wheel assembly axle. Frame 104 includes siderails 130, on which deck portions 106 and 108 are mounted, and which may further support additional elements and features of the vehicle, such as a charging port 132 and a power switch 134. Additionally, end bumpers, lighting assemblies, and other physical or electrical systems may be supported by siderails 130.

Vehicle 100 includes an electrical control system 136. Electrical control system 136 is an example of electrical control system 300 described below with respect to FIG. 6. Aspects of electrical control system 136 may be incorporated into first and/or second deck portions 106, 108. The electrical control system is described further below in Section C.

Wheel 124 is configured to be wide enough in a heel-toe direction that the rider can balance in the heel-toe direction manually, i.e., by shifting his or her own weight, without automated assistance from the vehicle. Ground contacting member 124 may be tubeless, or may be used with an inner tube. In some examples, ground contacting member 124 is a non-pneumatic tire. For example, ground contacting member 124 may be "airless", solid, and/or may comprise a foam. Ground contacting member 124 may have a profile such that the rider can lean vehicle 100 over an edge of the ground contacting member through heel and/or toe pressure to facilitate cornering of vehicle 100.

Motor assembly 126 may include any suitable driver of ground contacting member 124, such as a hub motor mounted within ground contacting portion 124. The hub motor may be internally geared or may be direct-drive. The use of a hub motor facilitates the elimination of chains and belts, and enables a form factor that considerably improves maneuverability, weight distribution, and aesthetics. Mounting ground contacting portion 124 onto motor assembly 126 may be accomplished by a split-rim design (e.g., using hub adapters) which may be bolted on to motor assembly 126, by casting or otherwise providing a housing of the hub motor such that it provides mounting flanges for a tire bead directly on the housing of the hub motor, or any other suitable method.

B. Illustrative Siderails

Figure 4:
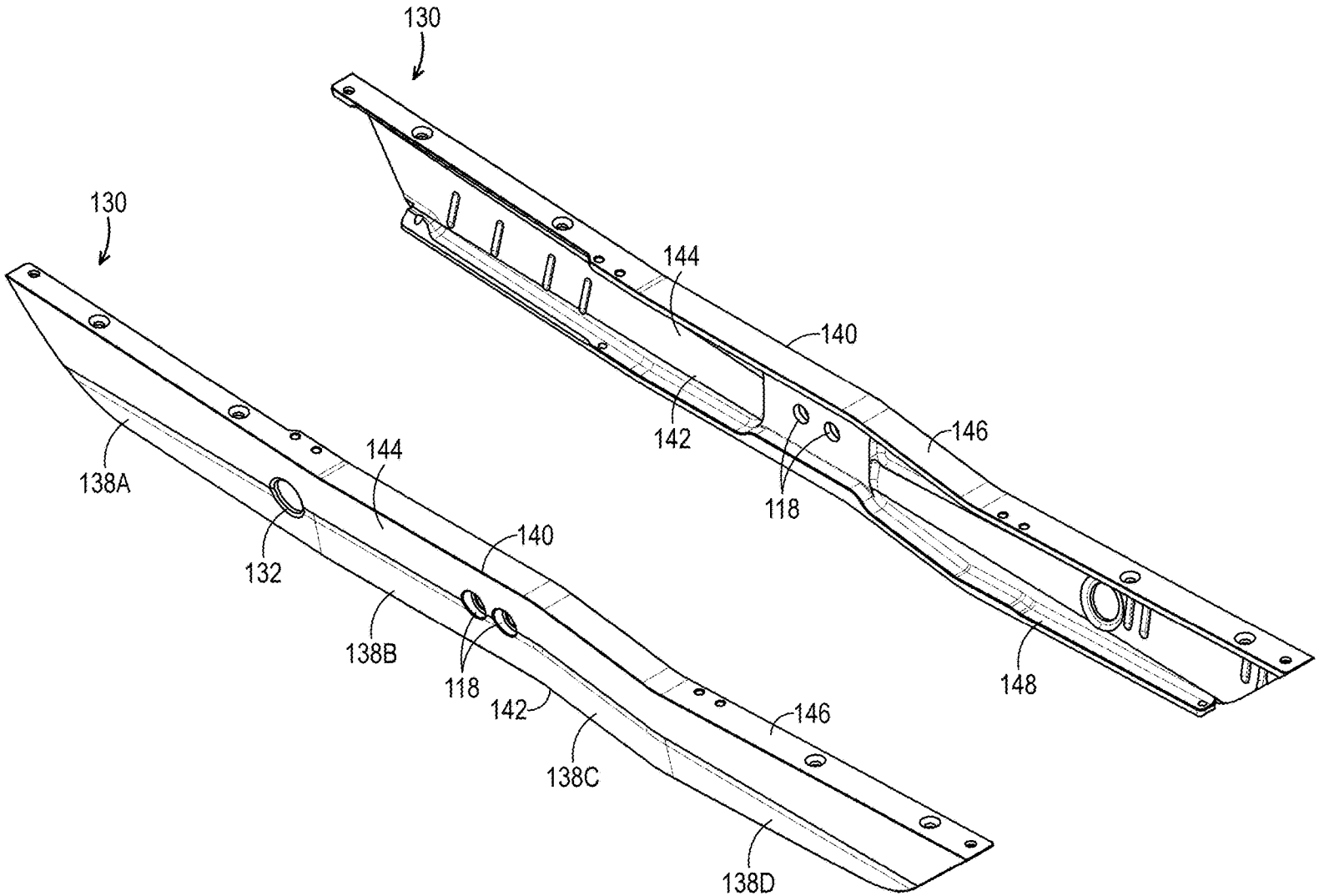
FIG. 4 is an isometric view of a pair of illustrative siderails according to the present teachings.
Figure 5:
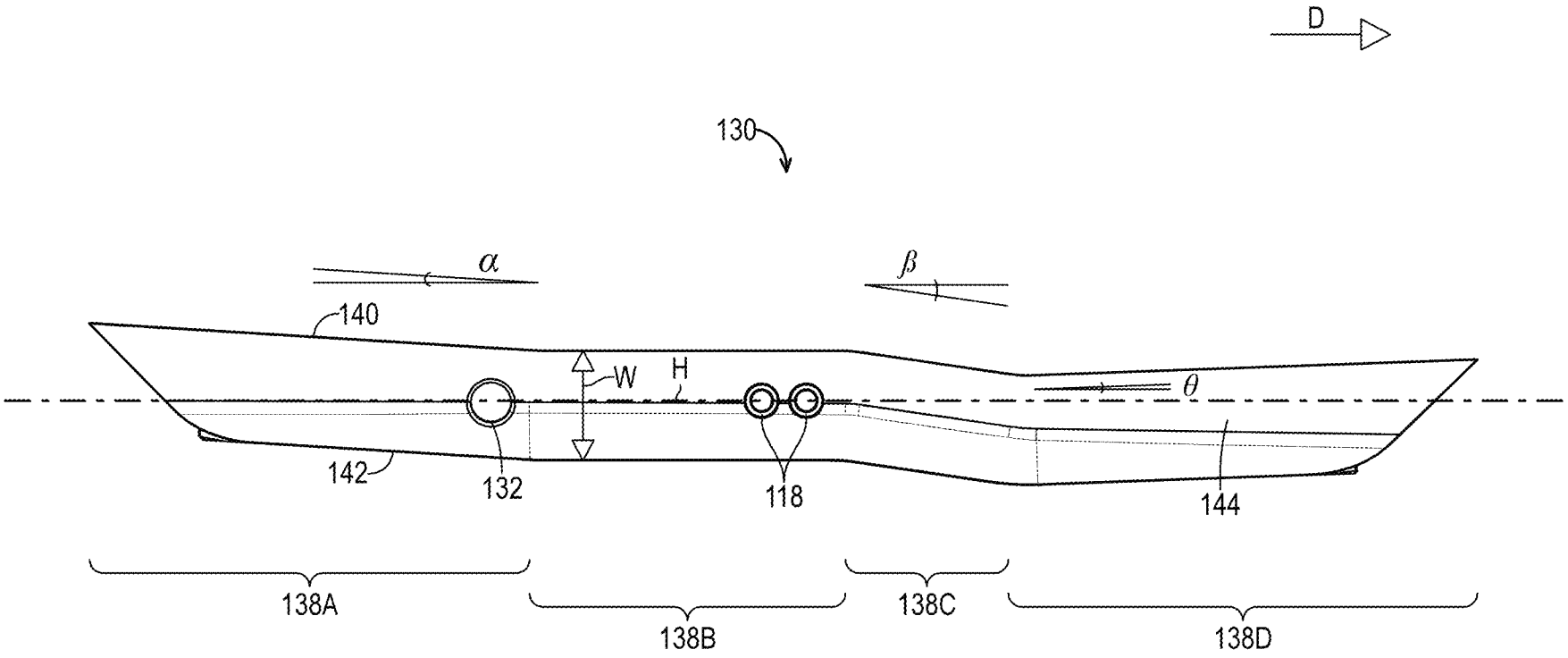
FIG. 5 is a side elevation view of one of the siderails of FIG. 4.

FIGS. 1-3 describe vehicle 100 supporting siderails 130. Siderails 130 are further illustrated in the isolated oblique isometric view of FIG. 4 and the side view of FIG. 5. Siderails 130 are examples of the siderails described in the Overview section above.

As described above with respect to vehicle 100, siderails 130 are configured to rigidly support the deck portions, and are coupled to the axle on either side of the tire. Siderails 130 each include a structural strip of material (e.g., steel or aluminum) having four contiguous sections or segments 138A, 138B, 138C, and 138D, arranged at angles to each other. When discussing the segments, unless stated otherwise, reference to various angles, orientations, and relative dispositions is understood to be with respect to the vehicle being in its normal operating orientation (e.g., upright with the wheel resting on an underlying surface), with a top edge 140 of the siderail farther from the ground than a bottom edge 142 of the siderail. Each of the segments is an elongate bar having a longitudinal centerline and a generally C-shaped or U-shaped cross section formed by the face or web 144 of the segment, a top mounting surface or flange 146 extending in an inboard direction from top edge 140, and a bottom mounting surface or flange 148 extending in an inboard direction from bottom edge 142. Although other configurations and profiles may be utilized (see, e.g., FIGS. 6 and 7), each segment of siderail 130 is generally linear. A width W of web 144 is defined as the distance between top edge 140 and bottom edge 142, as measured perpendicular to the edge. In some examples, siderail 130 has a constant width W along most or all of its length, i.e., each of the segments has the same width W. In some examples, distal segments 138A and 138D have tapered or otherwise shaped terminal end portions, and those end portions are excluded when discussing the general width W of the siderail. In some examples, width W varies by up to +/−10% along the length of the siderail. In some examples, edges of siderail 130 may have one or more cutouts or shaped portions, e.g., to accommodate other components or clearance requirements.

Central segment 138B defines a reference orientation (e.g., a zero-degree angle or an x-axis or "horizontal"). In the rearward direction, rear segment 138A extends at a shallow angle $\alpha$ (alpha) upward (e.g., +3 to +4 degrees above the reference, e.g., +3.5 degrees) from the central segment, such that a distal end of rear segment 138A is higher than central segment 138B. In the forward direction, first forward segment 138C extends at an angle $\beta$ (beta) downward (e.g., −8 to −10 degrees, or 8-10 degrees below the reference, e.g., −9 degrees) from the central segment, and second forward segment 138D (AKA the frontmost segment) extends at an angle $\theta$ (theta) upward (e.g., +1 to +3 degrees above the reference, e.g., +2 degrees). In other words, when central segment 138B is held in a horizontal position, then going rearward the siderail angles up, and going forward the siderail angles down and then back up.

The four segments or sections of siderail 130 are contiguous, forming a continuous rail. Rear segment 138A extends directly from central segment 138B. Forward segment 138C extends directly from central segment 138B, and frontmost segment 138D extends directly from forward segment 138C. The entirety of siderail 130 extends from rear segment 138A to frontmost segment 138D. In some examples, siderail 130 is monolithic and/or formed as a single piece. In some examples, siderail 130 is a single extruded piece of aluminum or other suitable metal. In some examples, one or more segments may be formed separately and joined permanently together, e.g., by welding. In some examples, siderail 130 may be generated by additive manufacturing.

A reference height may be defined by top edge 140 of central segment 138B when in a horizontal orientation. By definition, the rear distal end of the siderail extends to a point higher than the reference height. In some examples, the front distal end of the siderail extends to a point below or lower than the reference height. In some examples, the rear distal end of the siderail extends to a point above or higher than the front distal end. In some examples, a rear end of the central section is level with or higher than a front end of the central section. In some examples, a top edge of the central section is linear and horizontal. In some examples, a top and/or bottom edge of the central section has a curvilinear profile. In some examples, the centers of the side-by-side apertures lie on a longitudinal centerline of the central section.

In some examples, first forward segment 138C is shorter than second forward segment 138D. In some examples, a lengthwise midpoint of the siderail lies on the central segment. In some examples, the central segment is configured to be fastened to the axle of vehicle 100 and bolt holes 118 are formed in central segment 138B. In some examples, the siderail has a width (top to bottom) and a length (end to end), such that an imaginary line connecting the front top corner of the siderail to the rear top corner of the siderail does not intersect any other portion of the siderail. In other words, the imaginary line is spaced apart from the other segments.

Top edge 140 and bottom edge 142 of siderail 130 generally follow each other, e.g., in a parallel fashion, with distal ends being tapered. Siderail 130 has a same width throughout a majority of its length. In some examples, the bottom edge of a siderail has a profile which essentially replicates the profile of the top edge. Transitions between segments may be sharp-cornered, serpentine, or a combination thereof (e.g., having radiused corners). In some examples, a plurality of the sections of the rail are generally rectilinear. At least one of the sections may have a curvilinear profile, and at least one transition between adjacent sections may be radiused.

Because siderail 130 is (or is part of) frame 104 of vehicle 100, top surface or flange 146 of siderail 130 may include mounting features, such as bolt and screw holes, for attachment of one or more components (e.g., footpads or deck portions). In similar fashion, bottom surface or flange 148 of siderail 130 may include mounting features for attachment of skid plates 152 or the like.

Figure 6:
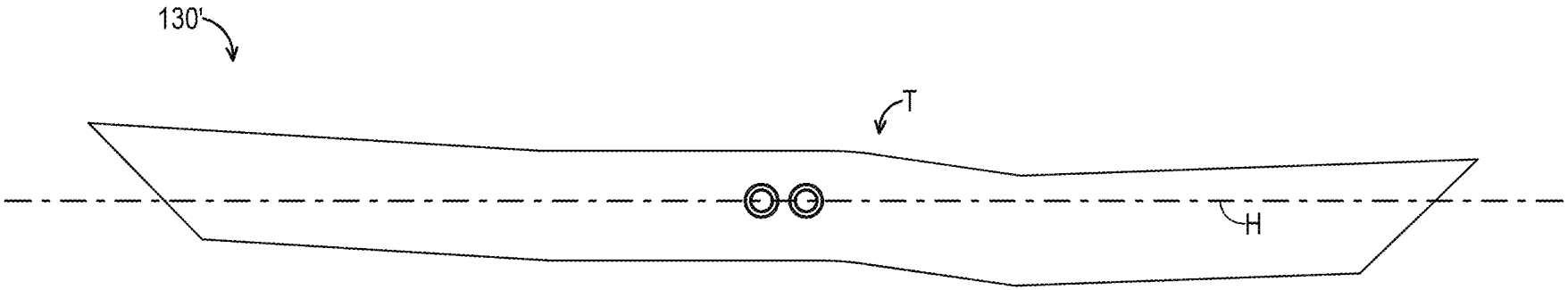
FIG. 6 is a side elevation view of another illustrative embodiment of a siderail in accordance with aspects of the present disclosure.
Figure 7:
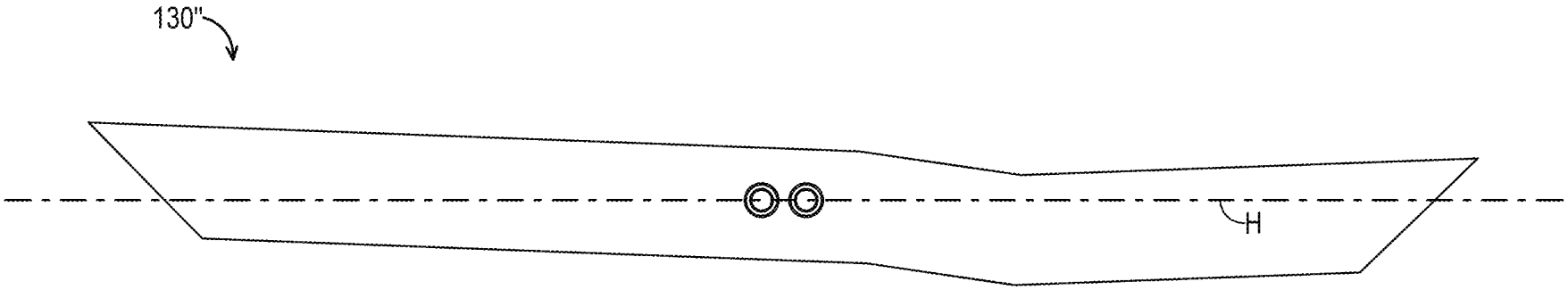
FIG. 7 is a side elevation view of another illustrative embodiment of a siderail in accordance with aspects of the present disclosure.

FIGS. 6 and 7 depict further illustrative examples of the siderails described in the Overview. Siderail 130' is substantially similar to siderail 130 of FIG. 5, with the transition T between the central section and the first forward section being curvilinear or radiused. Siderail 130" of FIG. 7 is similar to siderail 130 of FIG. 5, with the rearmost segment extending from the rear end of the rail through the central apertures to connect with the first forward segment.

C. Electrical Control System

Figure 8:
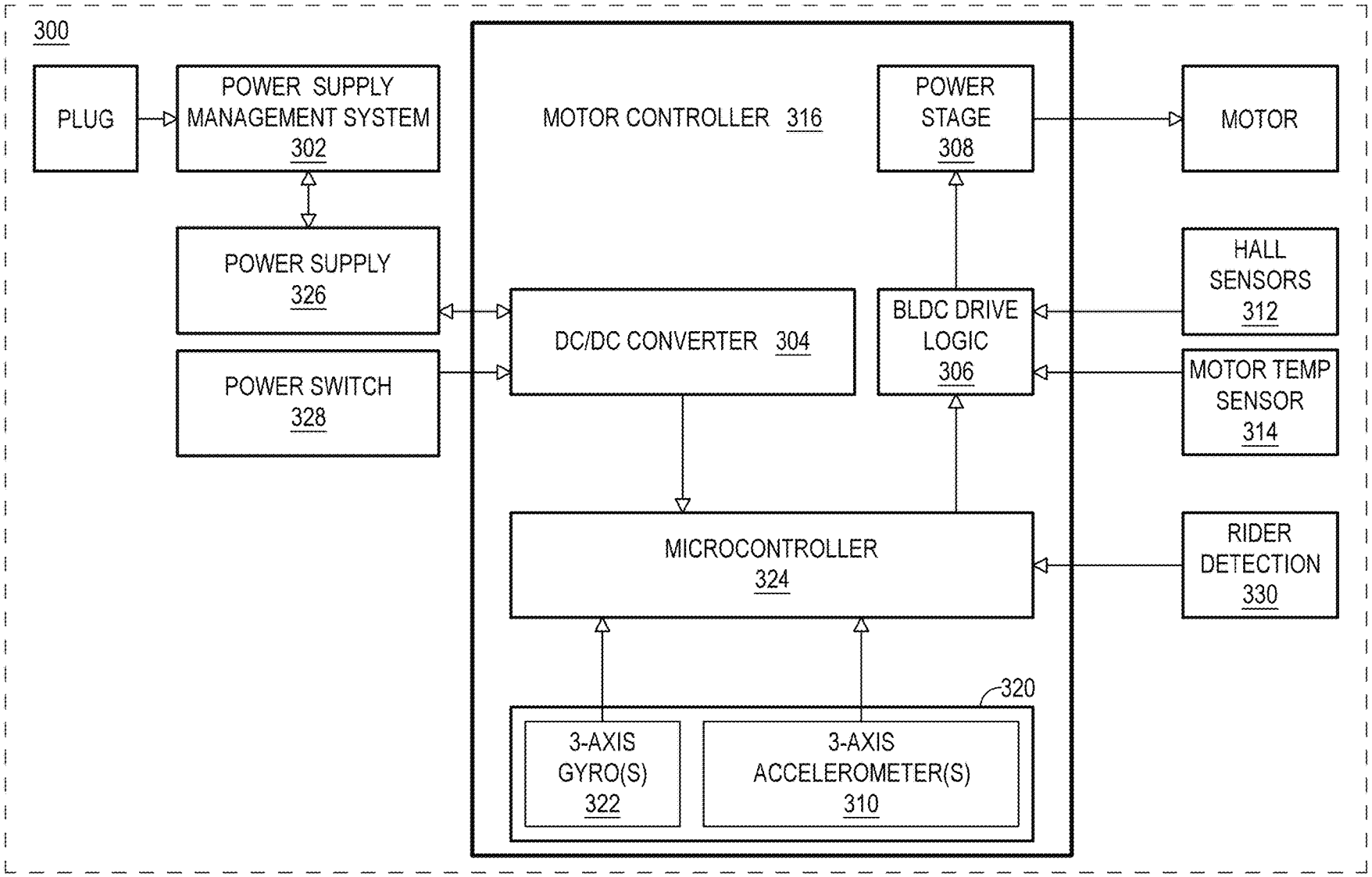
FIG. 8 is a schematic block diagram of an electrical control system suitable for use in the vehicle of FIG. 1.

FIG. 8 shows a block diagram of an electrical control system 300, an example of electrical control system 136 described briefly above, comprising various illustrative electrical components of vehicle 100. The electrical components may include a power supply management system 302, a direct current to direct current (DC/DC) converter 304, a brushless direct current (BLDC) drive logic 306, a power stage 308, one or more 2-axis accelerometers 310, one or more hall sensors 312, and/or a motor temperature sensor 314. DC/DC converter 304, BLDC drive logic 306, and power stage 308 may be included in and/or connected to a motor controller 316. Accelerometer(s) 310 may be included in the one or more orientation or tilt sensors 318 mentioned above.

Active balancing (or self-stabilization) of the electric vehicle may be achieved through the use of a feedback control loop or mechanism. The feedback control mechanism may include sensors 320, which may be electrically coupled to and/or included in motor controller 316. Preferably, the feedback control mechanism includes a Proportional-Integral-Derivative (PID) control scheme using one or more gyros 322 and one or more accelerometers (e.g., accelerometer(s) 310). Gyro 322 may be configured to measure a pivoting of the board about its pitch axis (also referred to as the fulcral axis). Gyro 322 and accelerometer 310 may be collectively configured to estimate (or measure, or sense) a lean angle of the board, such as an orientation of the foot deck about the pitch, roll and/or yaw axes. In some embodiments, gyro 322 and accelerometer 310 may be collectively configured to sense orientation information sufficient to estimate the lean angle of the frame, including pivotation about the pitch, roll and/or yaw axes.

As mentioned above, orientation information of the board may be measured (or sensed) by gyro 322 and accelerometer 310. The respective measurements (or sense signals) from gyro 322 and accelerometer 310 may be combined using a complementary or Kalman filter to estimate a lean angle of the board (e.g., pivoting of the board about the pitch, roll, and/or yaw axes, with pivoting about the pitch axis corresponding to a pitch angle, pivoting about the roll axis corresponding to a roll or heel-toe angle, and pivoting about the yaw axis corresponding to a side-to-side yaw angle) while filtering out the impacts of bumps, road texture and disturbances due to steering inputs. For example, gyro 322 and accelerometer 310 may be connected to a microcontroller 324, which may be configured to correspondingly measure movement of the board about and along the pitch, roll, and/or yaw axes.

Alternatively, the electronic vehicle may include any suitable sensor and feedback control loop configured to self-stabilize a vehicle, such as a 1-axis gyro configured to measure pivotation of the board about the pitch axis, a 1-axis accelerometer configured to measure a gravity vector, and/or any other suitable feedback control loop, such as a closed-loop transfer function. Additional accelerometer and gyro axes may allow improved performance and functionality, such as detecting if the board has rolled over on its side or if the rider is making a turn.

The feedback control loop may be configured to drive the motor to reduce an angle of the board with respect to the ground. For example, if a rider were to angle the board downward, so that the first deck portion was 'lower' than the second deck portion (e.g., if the rider pivoted the board in a first rotational direction), then the feedback loop may drive the motor to cause rotation of tire about the pitch axis in the first rotational direction, thereby causing a force on the board in the second, opposing rotational direction.

Thus, motion of the electric vehicle may be achieved by the rider leaning his or her weight toward a selected (e.g., "front") foot. Similarly, deceleration may be achieved by the rider leaning toward the other (e.g., "back" foot). Regenerative braking can be used to slow the vehicle. Sustained operation may be achieved in either direction by the rider maintaining their lean toward either selected foot.

As indicated in FIG. 8, microcontroller 324 may be configured to send a signal to brushless DC (BLDC) drive logic 306, which may communicate information relating to the orientation and motion of the board. BLDC drive logic 306 may then interpret the signal and communicate with power stage 308 to drive the motor accordingly. Hall sensors 312 may send a signal to the BLDC drive logic to provide feedback regarding a substantially instantaneous rotational rate of the rotor of the motor. Motor temperature sensor 314 may be configured to measure a temperature of the motor and send this measured temperature to logic 306. Logic 306 may limit an amount of power supplied to the motor based on the measured temperature of the motor to prevent the motor from overheating.

Certain modifications to the PID loop or other suitable feedback control loop may be incorporated to improve performance and safety of the electric vehicle. For example, integral windup may be prevented by limiting a maximum integrator value, and an exponential function may be applied to a pitch error angle (e.g., a measure or estimated pitch angle of the board).

Alternatively or additionally, some embodiments may include neural network control, fuzzy control, genetic algorithm control, linear quadratic regulator control, state-dependent Riccati equation control, and/or other control algorithms. In some embodiments, absolute or relative encoders may be incorporated to provide feedback on motor position.

During turning, the pitch angle can be modulated by the heel-toe angle (e.g., pivoting of the board about the roll axis), which may improve performance and prevent a front inside edge of the board from touching the ground. In some embodiments, the feedback loop may be configured to increase, decrease, or otherwise modulate the rotational rate of the tire if the board is pivoted about the roll and/or yaw axes. This modulation of the rotational rate of the tire may exert an increased normal force between a portion of the board and the rider, and may provide the rider with a sense of "carving" when turning, similar to the feel of carving a snowboard through snow or a surfboard through water.

Once the rider has suitably positioned themselves on the board, the control loop may be configured to not activate until the rider moves the board to a predetermined orientation. For example, an algorithm may be incorporated into the feedback control loop, such that the control loop is not active (e.g., does not drive the motor) until the rider uses their weight to bring the board up to an approximately level orientation (e.g., 0 degree pitch angle). Once this predetermined orientation is detected, the feedback control loop may be enabled (or activated) to balance the electric vehicle and to facilitate a transition of the electric vehicle from a stationary mode (or configuration, or state, or orientation) to a moving mode (or configuration, or state, or orientation).

With continued reference to FIG. 8, the various electrical components may be configured to manage a power supply 326. For example, power supply management system 302 may be a battery management system configured to protect batteries of power supply 326 from being overcharged, over-discharged, and/or short-circuited. System 302 may monitor battery health, may monitor a state of charge in power supply 326, and/or may increase the safety of the vehicle. Power supply management system 302 may be connected between a charge plug of the vehicle and power supply 326. The rider (or other user) may couple a charger to the plug and re-charge power supply 326 via system 302.

In operation, power switch 328 may be activated (e.g., by the rider). Activation of switch 328 may send a power-on signal to converter 304. In response to the power-on signal, converter 304 may convert direct current from a first voltage level provided by power supply 326 to one or more other voltage levels. The other voltage levels may be different than the first voltage level. Converter 304 may be connected to the other electrical components via one or more electrical connections to provide these electrical components with suitable voltages.

Converter 304 (or other suitable circuitry) may transmit the power-on signal to microcontroller 324. In response to the power-on signal, microcontroller may initialize sensors 320, and a rider detection device 330.

The electric vehicle may include one or more safety mechanisms, such as power switch 328 and/or rider detection device 330 to ensure that the rider is on the board before engaging the feedback control loop. In some embodiments, rider detection device 330 may be configured to determine if the rider's feet are disposed on the foot deck, and to send a signal causing the motor to enter an active state when the rider's feet are determined to be disposed on the foot deck.

Rider detection device 330 may include any suitable mechanism, structure, or apparatus for determining whether the rider is on the electric vehicle. For example, device 330 may include one or more mechanical buttons, one or more capacitive sensors, one or more inductive sensors, one or more optical switches, one or more force resistive sensors, and/or one or more strain gauges. Rider detection device 330 may be located on or under either or both of the first and second deck portions. In some examples, the one or more mechanical buttons or other devices may be pressed directly (e.g., if on the deck portions), or indirectly (e.g., if under the deck portions), to sense whether the rider is on the board.

In some examples, the one or more capacitive sensors and/or the one or more inductive sensors may be located on or near a surface of either or both of the deck portions, and may correspondingly detect whether the rider is on the board via a change in capacitance or a change in inductance. In some examples, the one or more optical switches may be located on or near the surface of either or both of the deck portions. The one or more optical switches may detect whether the rider is on the board based on an optical signal. In some examples, the one or more strain gauges may be configured to measure board or axle flex imparted by the rider's feet to detect whether the rider is on the board. In some embodiments, rider detection device 330 may include a hand-held "dead-man" switch.

If device 330 detects that the rider is suitably positioned on the electric vehicle, then device 330 may send a rider-present signal to microcontroller 324. The rider-present signal may be the signal causing the motor to enter the active state. In response to the rider-present signal (and/or, for example, the board being moved to the level orientation), microcontroller 324 may activate the feedback control loop for driving the motor. For example, in response to the rider-present signal, microcontroller 324 may send board orientation information (or measurement data) from sensors 320 to logic 306 for powering the motor via power stage 308.

In some embodiments, if device 338 detects that the rider is no longer suitably positioned or present on the electric vehicle, device 338 may send a rider-not-present signal to microcontroller 324. In response to the rider-not-present signal, circuitry of the vehicle (e.g., microcontroller 324, logic 306, and/or power stage 308) may be configured to reduce a rotational rate of the rotor relative to the stator to bring the vehicle to a stop. For example, the electric coils of the rotor may be selectively powered to reduce the rotational rate of the rotor. In some embodiments, in response to the rider-not-present signal, the circuitry may be configured to energize the electric coils with a relatively strong and/or substantially continuously constant voltage, to lock the rotor relative to the stator, to prevent the rotor from rotating relative to the stator, and/or to bring the rotor to a sudden stop.

In some embodiments, the vehicle may be configured to actively drive the motor even though the rider may not be present on the vehicle (e.g., temporarily), which may allow the rider to perform various tricks. For example, rider detection device 330 may be configured to delay sending the rider-not-present signal to the microcontroller for a predetermined duration of time, and/or the microcontroller may be configured to delay sending the signal to logic 306 to cut power to the motor for a predetermined duration of time.

D. Illustrative Combinations and Additional Examples

This section describes additional aspects and features of one-wheeled vehicles and segmented siderails, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A siderail for a one-wheeled vehicle, the siderail comprising:
- a structural rail extending from a front longitudinal end to a rear longitudinal end, two side-by-side apertures passing through a web of the rail and configured to receive corresponding fasteners to couple the rail (directly or indirectly) to an axle of the one-wheeled vehicle;
- wherein an imaginary line through the centers of the two apertures defines a horizontal reference;
- wherein the rail comprises a rearmost section extending rearward at an upward angle relative to the horizontal and a frontmost section extending forward at an upward angle relative to the horizontal; and wherein the rear longitudinal end of the rail is higher than the front longitudinal end of the rail.

A1. The siderail of A0, wherein an entirety of a top edge of the rearmost section is above the frontmost section.

A2. The siderail of A0 of A1, wherein the rail further comprises a forward section extending forward at a downward angle relative to the horizontal, wherein the frontmost section extends forward from the forward section at an upward angle relative to the horizontal.

A3. The siderail of any one of A0 through A2, the rail further comprising a central section comprising the two apertures.

A4. The siderail of A3, wherein the rearward section and the forward section extend directly from opposite ends of the central section.

A5. The siderail of A3 or A4, wherein a rear end of the central section is level with or higher than a front end of the central section.

A6. The siderail of A5, wherein a top edge of the central section is linear and horizontal.

A7. The siderail of any one of A3 through A6, wherein a top and/or bottom edge of the central section has a curvilinear profile.

A8. The siderail of any one of A3 through A7, wherein the centers of the side-by-side apertures lie on a longitudinal centerline of the central section.

A9. The siderail of any one of A0 through A8, wherein a plurality of the sections of the rail are generally rectilinear.

A10. The siderail of any one of A0 through A9, wherein at least one of the sections has a curvilinear profile.

A11. The siderail of any one of A0 through A10, wherein at least one transition between adjacent sections is radiused.

A12. The siderail of any one of A0 through A11, wherein the rail includes top and bottom flanges extending in a same direction to form a C-shaped profile.

A13. The siderail of A12, wherein the top flange comprises one or more apertures configured to receive mounting hardware of one or more deck portions of the one-wheeled vehicle.

A14. The siderail of any one of A0 through A13, wherein the second forward section has a tapered distal end.

A15. The siderail of any one of A0 through A14, wherein the rear section has a tapered distal end.

A16. The siderail of any one of A0 through A15, wherein each of the sections has a same width.

A17. The siderail of any one of A0 through A16, wherein the rail is formed as a single piece (e.g., extruded).

A18. A one-wheeled vehicle comprising the siderail of any one of A0 through A17.

B0. A siderail for a one-wheeled vehicle, the siderail comprising:
- an elongate structural rail having a web extending from a first longitudinal end to a second longitudinal end and having a top edge and a bottom edge;
- wherein the rail includes or is defined by or consists essentially of four segments:
  - a central segment defining a horizontal reference,
  - a rear segment (e.g., coupled directly to and) extending (e.g., away) from the central segment at an upward angle,
  - a first forward segment (e.g., coupled directly to and) extending (e.g., away) from the central segment at a downward angle, and
  - a second forward segment (e.g., coupled directly to and) extending (e.g., away) from the first forward segment at an upward angle.

B1. The siderail of B0, wherein an entirety of the rail consists (or consists essentially) of the four segments.

B2. The siderail of B0 or B1, wherein the rail includes top and bottom flanges extending in a same direction to form a C-shaped profile.

B3. The siderail of B2, wherein the top flange comprises one or more apertures configured to receive mounting hardware of one or more deck portions of the one-wheeled vehicle.

B4. The siderail of any one of B0 through B3, wherein the second forward segment has a tapered distal end.

B5. The siderail of any one of B0 through B4, wherein the rear segment has a tapered distal end.

B6. The siderail of any one of B0 through B5, wherein each of the four segments has a same width measured from the top edge to the bottom edge.

B7. The siderail of any one of B0 through B6, wherein transitions between adjacent segments are radiused.

B8. The siderail of any one of B0 through B7, wherein one or more of the segments are rectilinear.

B9. The siderail of any one of B0 through B8, wherein the central segment comprises a pair of side-by-side bolt holes configured to attach the siderail to an axle of the one-wheeled vehicle.

B10. The siderail of B9, wherein centers of the side-by-side bolt holes lie on a longitudinal centerline of the central segment.

B11. The siderail of any one of B0 through B10, wherein a distal end of the second forward segment is a front distal end of the siderail and a distal end of the rear segment is a rear distal end of the siderail.

B12. The siderail of B11, wherein the front distal end is lower than the rear distal end when the central segment is horizontal.

B13. The siderail of any one of B0 through B12, wherein the rear segment extends upward at an angle of 3 to 4 degrees above horizontal.

B14. The siderail of any one of B0 through B13, wherein the first forward segment extends downward at an angle of 8 to 10 degrees below horizontal.

B15. The siderail of any one of B0 through B14, wherein the second forward segment extends upward at an angle of 1 to 3 degrees above horizontal.

B16. The siderail of any one of B0 through B15, wherein the rail is formed as a single piece (e.g., extruded).

B17. A one-wheeled vehicle comprising the siderail of any one of B0 through B16.

C0. A one-wheeled vehicle, comprising:

a board including first and second deck portions coupled to a frame, each deck portion configured to receive a left or right foot of a rider oriented generally perpendicular to a direction of travel of the board;

a wheel disposed between and extending above the first and second deck portions;

a hub motor configured to rotate the wheel around an axle to propel the vehicle;

and a motor controller configured to cause the hub motor to propel the vehicle based on an orientation of the board;

wherein the frame comprises a siderail having a web extending from a first longitudinal end to a second longitudinal end, a top edge, and a bottom edge;

wherein the siderail is defined by four segments:

a central segment defining a horizontal reference, a rear segment extending from the central segment at an upward angle, a first forward segment extending from the central segment at a downward angle, and a second forward segment extending from the first forward segment at an upward angle.

C1. The vehicle of C0, wherein the web of the siderail is visible when the vehicle is in operation.

C2. The vehicle of C0 or C1, wherein an entirety of the siderail consists (or consists essentially) of the four segments.

C3. The vehicle of any one of C0 through C2, wherein the siderail includes top and bottom flanges extending in a same direction to form a C-shaped profile.

C4. The vehicle of C3, wherein the top flange comprises one or more apertures configured to receive mounting hardware of one or more deck portions of the one-wheeled vehicle.

C5. The vehicle of any one of C0 through C4, wherein the second forward segment has a tapered distal end.

C6. The vehicle of any one of C0 through C5, wherein the rear segment has a tapered distal end.

C7. The vehicle of any one of C0 through C6, wherein each of the four segments has a same width measured from the top edge to the bottom edge.

C8. The vehicle of any one of C0 through C7, wherein transitions between adjacent segments are radiused.

C9. The vehicle of any one of C0 through C8, wherein one or more of the segments are rectilinear.

C10. The vehicle of any one of C0 through C9, wherein the central segment comprises a pair of side-by-side bolt holes, and the siderail is fastened to the axle of the one-wheeled vehicle through the bolt holes.

C11. The vehicle of C10, wherein centers of the side-by-side bolt holes lie on a longitudinal centerline of the central segment.

C12. The vehicle of any one of C0 through C11, wherein a distal end of the second forward segment is a front distal end of the siderail and a distal end of the rear segment is a rear distal end of the siderail.

C13. The vehicle of C12, wherein the front distal end is lower than the rear distal end when the central segment is horizontal.

C14. The vehicle of any one of C0 through C13, wherein the rear segment extends upward at an angle of 3 to 4 degrees above horizontal.

C15. The vehicle of any one of C0 through C14, wherein the first forward segment extends downward at an angle of 8 to 10 degrees below horizontal.

C16. The vehicle of any one of C0 through C15, wherein the second forward segment extends upward at an angle of 1 to 3 degrees above horizontal.

C17. The vehicle of any one of C0 through C16, wherein the siderail is formed as a single piece.

D0. A siderail for a one-wheeled vehicle, the siderail comprising:

an elongate structural rail having four segments:

a central segment defining a horizontal reference, a rear segment extending from the central segment and angled up relative to the central segment (with a rear end of the segment being higher than a front end of the segment), a first forward segment extending from the central segment and angled down with respect to the central segment (with a rear end of the segment being higher than a front end of the segment), and a second forward segment extending from the first forward segment and angled up with respect to the first forward segment (with a rear end of the segment being lower than a front end of the segment).

D1. A one-wheeled vehicle, comprising:

a board including first and second deck portions coupled to a frame, each deck portion configured to receive a left or right foot of a rider oriented generally perpendicular to a direction of travel of the board;

a wheel disposed between and extending above the first and second deck portions;

a hub motor configured to rotate the wheel around an axle to propel the vehicle; and a motor controller configured to cause the hub motor to propel the vehicle based on an orientation of the board;

wherein the frame comprises the siderail of D0.

E0. A one-wheeled vehicle, comprising:

a board including first and second deck portions coupled to a frame, each deck portion configured to receive a left or right foot of a rider oriented generally perpendicular to a direction of travel of the board;

a wheel disposed between and extending above the first and second deck portions;

a hub motor configured to rotate the wheel around an axle to propel the vehicle; and a motor controller configured to cause the hub motor to propel the vehicle based on an orientation of the board;

wherein the frame comprises a siderail having a web extending from a first longitudinal end to a second longitudinal end;

wherein the siderail includes:

a rear segment extending rearward at an upward angle, a first forward segment extending forward at a downward angle, and a second forward segment extending from the first forward segment at an upward angle.

E1. The vehicle of E0, wherein the web of the siderail is visible when the vehicle is in operation.

E2. The vehicle of E0 or E1, further comprising a central segment, wherein the rear segment extends from a rear end of the central segment and the first forward segment extends from a front end of the central segment.

E3. The vehicle of E2, wherein the siderail consists essentially of the rear, central, first forward, and second forward segments.

E4. The vehicle of E2 or E3, wherein the central segment comprises a pair of side-by-side bolt holes, the siderail is fastened to the axle of the one-wheeled vehicle through the bolt holes, and a horizontal reference is defined by an imaginary line passing through centers of the pair of side-by-side bolt holes.

E5. The vehicle of any one of E0 through E4, wherein the siderail includes top and bottom flanges extending in a same direction to form a C-shaped profile.

E6. The vehicle of E5, wherein the top flange comprises one or more apertures receiving mounting hardware of the first and second deck portions.

E7. The vehicle of any one of E0 through E6, wherein each of the segments has a same width measured from a top edge to a bottom edge.

E8. The vehicle of any one of E0 through E7, wherein transitions between adjacent segments are radiused.

E9. The vehicle of any one of E0 through E8, wherein one or more of the segments are rectilinear.

E10. The vehicle of any one of E0 through E9, wherein a distal end of the second forward segment is a front distal end of the siderail and a distal end of the rear segment is a rear distal end of the siderail.

Advantages, Features, and Benefits

The different embodiments and examples of the siderails described herein provide several advantages over known solutions. For example, illustrative embodiments and examples described herein allow improved clearance for the rear end of the vehicle, e.g., while travelling downhill.

Additionally, and among other benefits, illustrative embodiments and examples described herein allow a lower center of gravity for the vehicle without compromising front end clearance.

Additionally, and among other benefits, illustrative embodiments and examples described herein create different heights for the two deck portions, enhancing control and foot support and comfort for some users. In some examples, segmented rails as described herein may improve slip resistance.

Additionally, and among other benefits, illustrative embodiments and examples described herein may improve sensitivity of gyro and/or accelerometer systems as described herein by slightly spacing the deck portions away from the hub motor.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A siderail for a one-wheeled vehicle, the siderail comprising:

a structural rail extending from a front longitudinal end to a rear longitudinal end, two side-by-side apertures passing through a web of the rail and configured to receive corresponding fasteners to couple the rail to an axle of the one-wheeled vehicle;

wherein an imaginary line through centers of the two apertures defines a horizontal reference;

wherein the rail comprises a rearmost section extending rearward at an upward angle relative to the horizontal reference and a frontmost section extending forward at an upward angle relative to the horizontal reference, wherein an entirety of a top edge of the rearmost section is disposed above the frontmost section, and wherein adjacent sections of the rail extend at different angles relative to the horizontal reference than each other; and wherein the rear longitudinal end of the rail is higher than the front longitudinal end of the rail.

2. The siderail of claim 1, wherein the rail further comprises a forward section extending forward at a downward angle relative to the horizontal reference, wherein the frontmost section extends forward from the forward section at an upward angle relative to the horizontal reference.

3. The siderail of claim 1, the rail further comprising a central section comprising the two apertures, wherein the rearmost section and the forward section extend directly from opposite ends of the central section.

4. The siderail of claim 3, wherein a rear end of the central section is level with or higher than a front end of the central section.

5. The siderail of claim 4, wherein a top edge of the central section is linear and horizontal.

6. The siderail of claim 1, wherein a plurality of the sections of the rail are generally rectilinear.

7. The siderail of claim 1, wherein at least one transition between adjacent sections is radiused.

8. The siderail of claim 1, wherein the rail is formed as a single piece.

9. A one-wheeled vehicle, comprising:

a board including first and second deck portions coupled to a frame, each deck portion configured to receive a left or right foot of a rider oriented generally perpendicular to a direction of travel of the board;

a wheel disposed between and extending above the first and second deck portions;

a hub motor configured to rotate the wheel around an axle to propel the vehicle; and a motor controller configured to cause the hub motor to propel the vehicle based on an orientation of the board;

wherein the frame comprises a siderail having a web extending from a first longitudinal end to a second longitudinal end;

wherein the siderail includes:

two side-by-side fastener receivers, wherein the siderail is coupled to the axle by corresponding fasteners received by the two side-by-side fastener receivers, and wherein a horizontal reference is defined by an imaginary line passing through respective centers of the two side-by-side fastener receivers;

a rear segment extending rearward at an upward angle relative to the horizontal reference, a first forward segment extending forward at a downward angle relative to the horizontal reference, and a second forward segment extending from the first forward segment at an upward angle relative to the horizontal reference, wherein an entirety of a top edge of the rear segment is disposed above the first and second forward segments relative to the horizontal reference.

10. The vehicle of claim 9, wherein the web of the siderail is visible when the vehicle is in operation.

11. The vehicle of claim 9, further comprising a central segment, wherein the rear segment extends from a rear end of the central segment and the first forward segment extends from a front end of the central segment.

12. The vehicle of claim 11, wherein the siderail consists essentially of the rear, central, first forward, and second forward segments.

13. The vehicle of claim 9, wherein the siderail includes top and bottom flanges extending in a same direction to form a C-shaped profile.

14. The vehicle of claim 13, wherein the top flange comprises one or more apertures receiving mounting hardware of the first and second deck portions.

15. The vehicle of claim 9, wherein each of the segments has a same width measured from a top edge to a bottom edge.

16. The vehicle of claim 9, wherein transitions between adjacent segments are radiused.

17. The vehicle of claim 9, wherein one or more of the segments are rectilinear.

18. The vehicle of claim 9, wherein a distal end of the second forward segment is a front distal end of the siderail and a distal end of the rear segment is a rear distal end of the siderail.

19. The vehicle of claim 9, wherein the first longitudinal end is a front longitudinal end of the siderail and the second longitudinal end is a rear longitudinal end of the siderail, and wherein the rear longitudinal end is higher than the front longitudinal end relative to the horizontal reference.

20. The vehicle of claim 9, wherein adjacent segments of the siderail extend at different angles relative to the horizontal reference than each other.

* * * * *